US011043749B2

(12) United States Patent
Wu et al.

(10) Patent No.: US 11,043,749 B2
(45) Date of Patent: Jun. 22, 2021

(54) ANTENNA STRUCTURE

(71) Applicant: PEGATRON CORPORATION, Taipei (TW)

(72) Inventors: Chien-Yi Wu, Taipei (TW); Shih-Keng Huang, Taipei (TW); Sheng-Chin Hsu, Taipei (TW); Chao-Hsu Wu, Taipei (TW); Hau Yuen Tan, Taipei (TW); Tse-Hsuan Wang, Taipei (TW); Yi-Ru Yang, Taipei (TW); Cheng-Hsiung Wu, Taipei (TW); Ching-Hsiang Ko, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 16/802,223

(22) Filed: Feb. 26, 2020

(65) Prior Publication Data

US 2020/0358195 A1 Nov. 12, 2020

(30) Foreign Application Priority Data

May 9, 2019 (TW) ..... 108116011

(51) Int. Cl.
*H01Q 21/06* (2006.01)
*H01Q 13/20* (2006.01)
*H01Q 1/48* (2006.01)

(52) U.S. Cl.
CPC ..... *H01Q 13/206* (2013.01); *H01Q 1/48* (2013.01); *H01Q 21/065* (2013.01)

(58) Field of Classification Search
CPC ..... H01Q 21/065; H01Q 13/206; H01Q 1/38–1/48
See application file for complete search history.

(56) References Cited

U.S. PATENT DOCUMENTS

| | | | | |
|---|---|---|---|---|
| 9,553,362 | B2 * | 1/2017 | Inoue | H01Q 1/38 |
| 2018/0115084 | A1 * | 4/2018 | Tsuchiya | H01Q 21/065 |
| 2019/0245276 | A1 * | 8/2019 | Li | H01Q 21/065 |

FOREIGN PATENT DOCUMENTS

| | | |
|---|---|---|
| CN | 203260725 | 10/2013 |
| CN | 106067605 | 9/2018 |
| TW | 494606 | 7/2002 |

* cited by examiner

*Primary Examiner* — Hasam Islam
(74) *Attorney, Agent, or Firm* — J.C. Patents

(57) ABSTRACT

An antenna structure includes a ground plane and at least one series-fed antenna. Each series-fed antenna includes a first patch, a plurality of second patches, a first microstrip line, a first grounding structure group, a plurality of second microstrip lines, and a plurality of second grounding structure groups. The first patch is disposed beside the ground plane. The first patch and the second patch are arranged along a straight line. The first microstrip line extends from the first patch and has a feeding point. The first grounding structure group includes two first grounding traces that extend symmetrically from both sides of the first microstrip line to the ground plane. The second microstrip lines are respectively connected between the first patch and the second patches. The second grounding structure groups are respectively disposed on both sides of the second microstrip lines, and are coupled to the ground plane.

11 Claims, 9 Drawing Sheets

ANTENNA STRUCTURE

CROSS-REFERENCE TO RELATED APPLICATION

This application claims the priority benefit of Taiwan application serial no. 108116011, filed on May 9, 2019. The entirety of the above-mentioned patent application is hereby incorporated by reference herein and made a part of this specification.

BACKGROUND

Technical Field

The present disclosure relates to an antenna structure, and in particular, to a wideband antenna structure.

Related Art

Currently, a millimeter-wave radar applied to the automotive market has good signal penetration and high distance detection accuracy due to high operating frequencies (77 GHz and 79 GHz), and is applicable to a long distance detection system, such as an automatic emergency braking (AEB) system, an adaptive cruise (ACC) system, a forward collision prevention (FCW) system, etc. However, currently, most millimeter-wave radar antennas are designed in a general series-fed antenna form, and therefore a bandwidth thereof is limited by about 2%.

SUMMARY

The present disclosure provides an antenna structure that may have a wideband characteristic.

The antenna structure of the present disclosure includes a ground plane and at least one series-fed antenna. Each series-fed antenna includes a first patch, a plurality of second patches, a first microstrip line, a first grounding structure group, a plurality of second microstrip lines, and a plurality of second grounding structure groups. The first patch is disposed beside the ground plane. The first patch is arranged between the ground plane and the second patches, and the first patch and the second patches are arranged along a straight line. The first microstrip line extends from the first patch in a direction away from the second patches and has a first end and a second end opposite to each other. The first end is a feeding point, and the second end is connected to the first patch. The first grounding structure group includes two first grounding traces. The two first grounding traces extend symmetrically from opposite sides of the first microstrip line to the ground plane. The second microstrip lines are respectively connected between the first patch and the second patch adjacent to the first patch and connected between the second patches. The second grounding structure groups are respectively disposed on both sides of the second microstrip lines, and are coupled to ground plane.

Based on the above, in an embodiment of the present disclosure, in the antenna structure, the two grounding traces are symmetrically disposed on the two opposite sides of the first microstrip line and extend to the ground plane, and the second grounding structure groups are respectively disposed on both sides of the second microstrip lines and are coupled to the ground plane. According to a simulation result in the embodiment, through the above design, a range of a frequency band coupled out by the antenna structure and an impedance bandwidth can be increased, so that the antenna structure has a good antenna characteristic.

To make the features and advantages of the present disclosure clear and easy to understand, the following gives a detailed description of embodiments with reference to accompanying drawings.

DETAILED DESCRIPTION

Figure 1A:
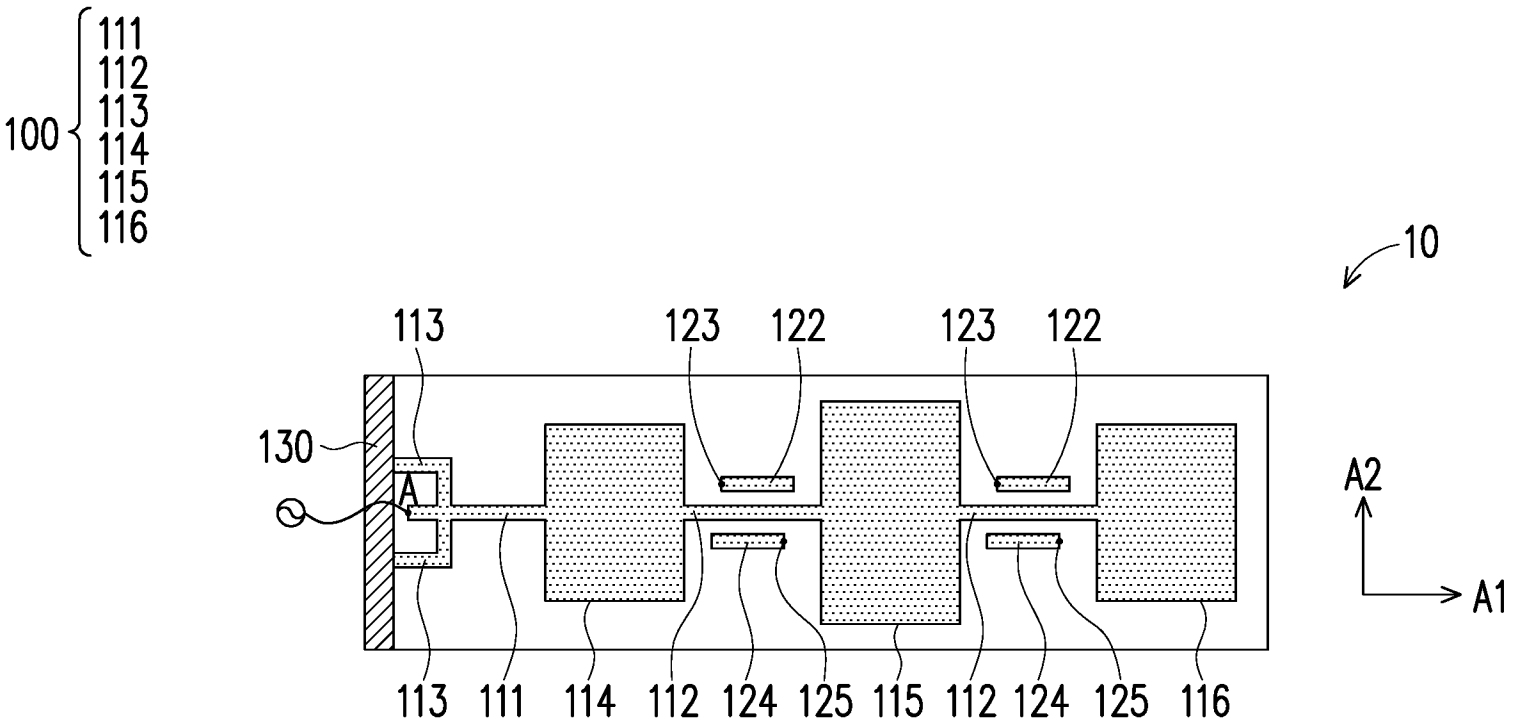
FIG. 1A is a schematic diagram of an antenna structure according to an embodiment of the present disclosure.
Figure 1C:
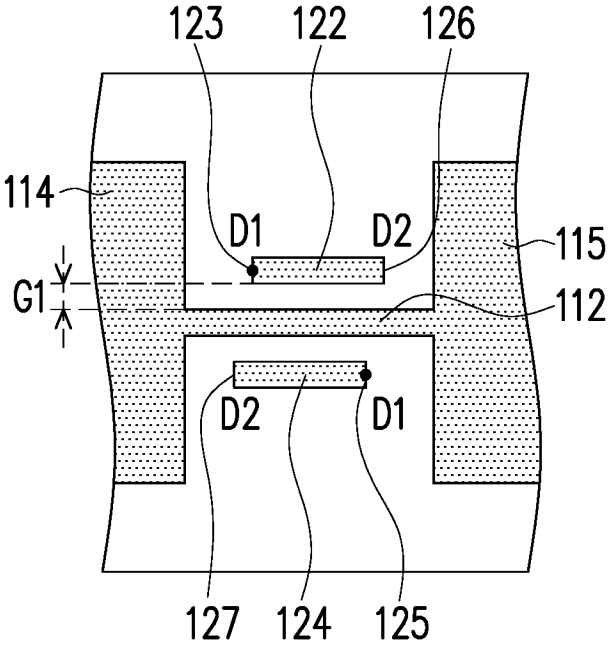
FIG. 1B and FIG. 1C are respectively partial schematic enlarged views of an antenna structure in FIG. 1A.
Figure 1B:
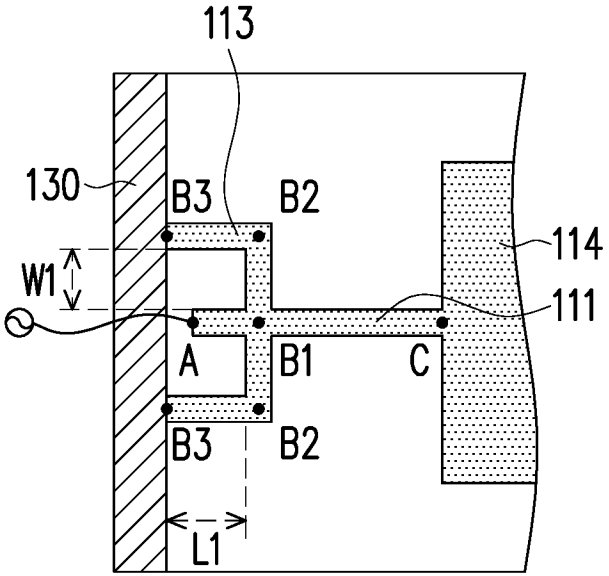

FIG. 1A is a schematic diagram of an antenna structure according to an embodiment of the present disclosure. FIG. 1B and FIG. 1C are respectively partial schematic enlarged views of an antenna structure in FIG. 1A. Referring to FIG. 1A to FIG. 1C, an antenna structure 10 in this embodiment includes a ground plane 130 and at least one series-fed antenna 100. In this embodiment, that the antenna structure 10 has one series-fed antenna 100 is used as an example, but a number of the series-fed antennas 100 is not limited thereto. In this embodiment, the series-fed antenna 100 includes a first patch 114, a plurality of second patches 115 and 116, a first microstrip line 111, a first grounding structure group (two first grounding traces 113), a plurality of second microstrip lines 112, and a plurality of second grounding structure groups (two second grounding traces 122 and 124).

As shown in FIG. 1A, in this embodiment, the first patch 114 is disposed beside the ground plane 130. The first patch 114 is arranged between the ground plane 130 and the second patches 115 and 116, and in particular, the first patch 114 is arranged between the ground plane 130 and the second patch adjacent to the first patch 114 (i.e., the second patch 115). The first patch 114 and the second patches 115 and 116 are arranged along one straight line. In this embodiment, there are two second patches 115 and 116, but a number of the second patches 115 and 116 is not limited thereto.

In this embodiment, an area of the first patch 114 and areas of the second patches 115 and 116 increase and then decrease along a direction (a direction A1) in which the straight line extends. The area of the first patch 114 is the same as an area of the second patch 116 far away from the first patch 114 and less than an area of the second patch 115 adjacent to the first patch 114. In other words, the series-fed antenna 100 is a patch antenna assembled in a tapered manner. Definitely, in other embodiments, the area of the first patch 114 may be the same as the area of each of the second patches 115 and 116. An area relationship between the first patch 114 and the second patches 115 and 116 is not limited thereto.

In addition, in this embodiment, the first patch 114 and each of the second patches 115 and 116 are rectangular. One side length (for example, a side length along the direction A1) of any of the first patch 114 and the second patches 115 and 116 is between 0.9 millimeters and 1.05 millimeters, and another side length (for example, a side length along a direction A2) is between 0.7 millimeters and 1.6 millimeters. Definitely, a relationship between dimensions of the first patch 114 and the second patches 115 and 116 is not limited thereto.

The first microstrip line 111 extends from the first patch 114 in a direction away from the second patches 115 and 116. More specifically, as shown in FIG. 1B, the first microstrip line 111 has a first end A and a second end C opposite to each other. The first end A is a feeding point, and the second end C is connected to the first patch 114. There is a distance between the first end A of the first microstrip line 111 and the ground plane 130 without contacting the ground plane 130. In this embodiment, the antenna structure 10 is adapted to couple out a frequency band ranging from about 77 GHz to 81 GHz, but the range of the frequency band is not limited thereto. A length of the first microstrip line 111 (that is, a distance between the first end A and the second end C) is between 0.39 times and 0.42 times a wavelength of the frequency band.

As shown in FIG. 1B, in this embodiment, the first grounding structure group includes two first grounding traces 113 that extend symmetrically from two opposite sides of the first microstrip line 111 to the ground plane 130. In each series-fed antenna 100, a length of the first grounding trace 113 is between 0.22 times and 0.28 times the wavelength of the frequency band, for example, 0.25 times the wavelength.

In this embodiment, the first grounding trace 113 includes a first segment (that is, a line segment B1B2) and a second segment (that is, a line segment B2B3) connected in a bent manner. The first segment (the line segment B1B2) extends vertically from the first microstrip line 111, and the second segment (the line segment B2B3) is parallel to the first microstrip line 111 and connected to the ground plane 130. A distance L1 between the first segment (the line segment B1B2) and the ground plane 130 is between 0.2 millimeters and 0.4 millimeters. It is worth mentioning that after simulation, when the distance L1 between the first segment (the line segment B1B2) and the ground plane 130 is gradually changed from 0.2 millimeters to 0.3 millimeters and 0.4 millimeters, a Smith chart of the antenna structure 10 has a clockwise rotation characteristic. When the distance L1 between the first segment (the line segment B1B2) and the ground plane 130 is 0.3 millimeters, a frequency band of the first grounding trace 113 may range from 77 GHz to 81 GHz, and therefore has good performance.

In addition, when the first segment (the line segment B1B2) or the second segment (the line segment B2B3) of the first grounding trace 113 widens outward, for example, the line segment B1B2 of the first grounding trace 113 is thickened rightward by 0.1 millimeters, 0.2 millimeters, and 0.3 millimeters, the upper line segment B2B3 is thickened upward by 0.1 millimeters, 0.2 millimeters, and 0.3 millimeters, and the lower line segment B2B3 is thickened downward by 0.1 millimeters, 0.2 millimeters, and 0.3 millimeters, the Smith chart of the antenna structure 10 has a clockwise rotation characteristic. When the second segment (the line segment B2B3) of the first grounding trace 113 is widened inward, for example, the upper line segment B2B3 of the first grounding trace 113 is thickened downward by 0.1 millimeters, 0.15 millimeters, and 0.2 millimeters, and the lower line segment B2B3 is thickened upward by 0.1 millimeters, 0.15 millimeters, and 0.2 millimeters, the Smith chart of the antenna structure 10 has a counterclockwise rotation characteristic. A designer may adjust a dimension of the first grounding trace 113 according to the above characteristics to obtain good antenna performance.

In addition, in this embodiment, a distance W1 between the second segment (the line segment B2B3) and the first microstrip line 111 is between 0.2 millimeters and 0.25 millimeters. It is worth mentioning that after simulation, the distance W1 between the second segment (the line segment B2B3) and the first microstrip line 111 is gradually changed from 0.2 millimeters to 0.23 millimeters, and 0.25 millimeters. Therefore, the Smith chart of the first grounding trace 113 has a clockwise rotation characteristic. When the distance W1 between the second segment (the line segment B2B3) and the first microstrip line 111 is 0.2 millimeters, an impedance matching effect at 77 GHz to 79 GHz is better. When the distance W1 between the second segment (the line segment B2B3) and the first microstrip line 111 is 0.25 millimeters, an impedance matching effect at 79 GHz to 81 GHz is better. When the distance W1 between the second segment (the line segment B2B3) and the first microstrip line 111 is 0.23 millimeters, the first grounding trace 113 may have a frequency ranging from 77 GHz to 81 GHz, and therefore has wideband performance. Definitely, the distances L1 and W1 are not limited thereto.

Returning back to FIG. 1A, in this embodiment, there are two second microstrip lines 112 corresponding to the two second patches 115 and 116. However, a number of the second microstrip lines 112 is not limited thereto. The second microstrip lines 112 are respectively connected between the first patch 114 and the second patch 115 adjacent to the first patch 114 and connected between the second patches 115 and 116. In addition, in this embodiment, the second microstrip lines 112 have a same length. However, in other embodiments, the second microstrip lines 112 may have different lengths.

In addition, in this embodiment, there are two second grounding structure groups corresponding to the two second microstrip lines 112, but a number of the second grounding structure groups is not limited thereto. The two second grounding structure groups are respectively disposed on both sides of the two second microstrip lines 112. Each of the second grounding structure groups includes two second grounding traces 122 and 124 symmetrically arranged on two opposite sides of the corresponding second microstrip line 112 and are respectively connected to the ground plane 130. The second grounding traces 122 and 124 are, for example, connected to a ground terminal located on a back surface of a substrate through a through hole, and are coupled to the ground plane 130.

As shown in FIG. 1C, in this embodiment, in each of the grounding structure groups, each of the second grounding traces 122 and 124 includes a first end 123 and 125 and a second end 126 and 127 respectively. In each of the grounding structure groups, the first end 123 and the second end 126 of the second grounding trace 122 respectively correspond to the second end 127 and the first end 125 of the second grounding trace 124, and the two first ends 123 and 125 are coupled to the ground plane to serve as two grounding terminals. In other words, the first end 123 of the second grounding trace 122 and the first end 125 of the second grounding trace 124 are respectively close to two opposite ends of the corresponding second microstrip line 112. In the design of grounding on the opposite sides, the Smith chart may be slightly smaller and an impedance bandwidth may be increased. Definitely, in other embodiments, relative positions of the first end 123 of the second grounding trace 122 and the first end 125 of the second grounding trace 124 are not limited thereto.

In addition, in this embodiment, a length of the second grounding traces 122 and 124 (that is, a distances between positions D1 and D2 in FIG. 1C) is between 0.2 times and 0.3 times the wavelength of the frequency band. For example, lengths of the second grounding traces 122 and 124 are between 0.65 millimeters and 0.85 millimeters, and widths of the second grounding traces 122 and 124 are between 0.08 millimeters and 0.12 millimeters. Definitely, the lengths and the widths of the second grounding traces 122 and 124 are not limited thereto. When the length (a line segment D1D2) of the second grounding traces 122 and 124 is gradually changed from 0.577 millimeters to 0.677 millimeters and 0.777 millimeters, it may be learned from the Smith chart that an impedance circle becomes larger and a frequency tends to be low. In this embodiment, when the lengths (the line segment D1D2) of the second grounding traces 122 and 124 are 0.777 millimeters, the second grounding traces 122 and 124 may have a frequency band ranging from 77 GHz to 81 GHz, and therefore have a relatively large impedance bandwidth.

In addition, in this embodiment, a distance G1 between the second microstrip line 112 and the second grounding traces 122, which is the same as the distance between the second microstrip line 112 and the second grounding traces 124, is between 0.08 millimeters and 0.12 millimeters, for example, is 0.1 millimeters, but the distance G1 is not limited thereto.

In this embodiment, in the antenna structure 100, the two first grounding traces 113 are symmetrically disposed on the two opposite sides of the first microstrip line 111 and extend to the ground plane 130, and the two second grounding traces 122 and 124 are symmetrically disposed on two opposite sides of the second microstrip line 112 and grounded in different directions respectively. According to a simulation result in the embodiment, through the above design, a range of a frequency band coupled out by the antenna structure 10 and an impedance bandwidth can be increased, so that the antenna structure 10 has a good antenna characteristic.

Figure 2:
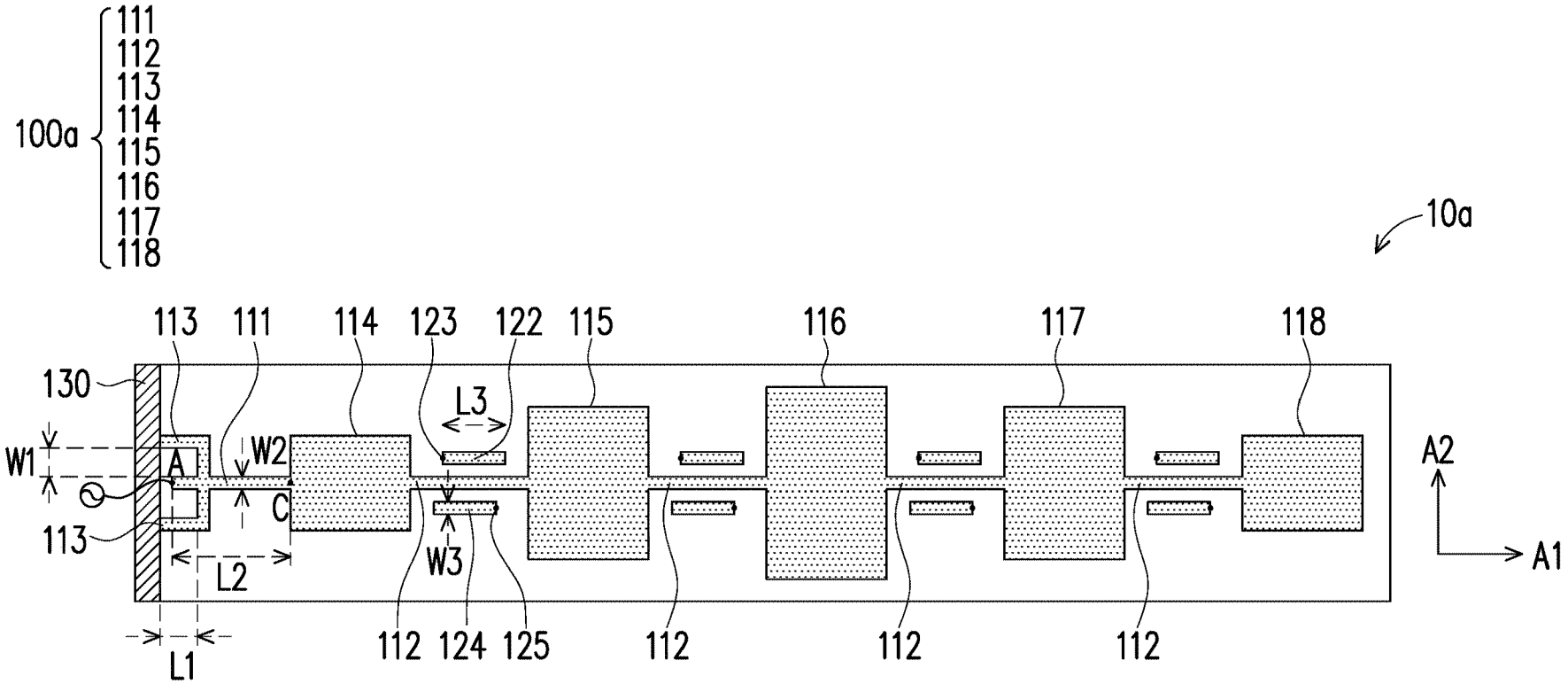
FIG. 2 is a schematic diagram of an antenna structure according to another embodiment of the present disclosure.

FIG. 2 is a schematic diagram of an antenna structure according to another embodiment of the present disclosure. Referring to FIG. 2, a main difference between an antenna structure 10*a* in FIG. 2 and the antenna structure 10 in FIG. 1A is that in this embodiment, a series-fed antenna 100*a* includes second patches 115, 116, 117, and 118. In other words, there are four second patches 115, 116, 117, and 118. There are four second microstrip lines 112, and there are four second grounding structure groups.

In this embodiment, an area of the first patch 114 and areas of the second patches 115, 116, 117, and 118 increase and then decrease along a direction (a direction A1) in which the straight line extends. More specifically, the second patch 116 at a central position has a largest area, the second patch 115 and the second patch 117 have second largest areas, and the first patch 114 and the second patch 118 have smallest areas. In this embodiment, the area of the first patch 114 is the same as the area of the second patch 118 farthest away from the first patch 114, the area of the second patch 115 is the same as the area of the second patch 117, and the area of first patch 114 is a half of the area of the second patch 116 at the central position.

In particular, in this embodiment, a dimension of the antenna structure 10*a* is 9.65 millimeters×1.57 millimeters×0.102 millimeters (which is a thickness of a substrate). A side length of the first patch 114 along the direction A1 is, for example, 0.96 millimeters, which is 0.416 times the wavelength of the frequency band coupled out by the antenna structure 10*a*. The side length of the first patch 114 along the direction A2 is, for example, 0.785 millimeters. A length of the first microstrip line 111 is 0.955 millimeters, which is 0.41 times the wavelength of the frequency band (77 GHz to 81 GHz) coupled out by the antenna structure 10*a*. A width of the first microstrip line 111 is 0.1 millimeters.

Side lengths of the second patches 115, 116, 117, and 118 along the direction A1 are, for example, 0.96 millimeters, which is 0.416 times the wavelength of the frequency band coupled out by the antenna structure 10*a*. The side lengths of the second patches 115, 116, 117, and 118 along the direction A2 are, for example, 1.24 millimeters, 1.57 millimeters, 1.24 millimeters, and 0.785 millimeters. A length of the second microstrip line 112 is 0.95 millimeters, which is 0.39 times the wavelength of the frequency band coupled out by the antenna structure 10*a*. A width of the second microstrip line 112 is 0.1 millimeters. Lengths of the second grounding traces 122 and 124 are about 0.777 millimeters and widths of the second grounding traces 122 and 124 are about 0.1 millimeters.

In this embodiment, through the first grounding structure group, a bandwidth of a frequency band coupled out by the antenna structure 10*a* can be increased to 4.82%. In this embodiment, through the second grounding structure group, the bandwidth of the frequency band coupled out by the antenna structure 10*a* can be increased to 5.06%. The antenna structure 10*a* can have a maximum gain from 11.09 dBi to 12.4 dBi at the frequency band of 77 GHz to 81 GHz.

Figure 3A:
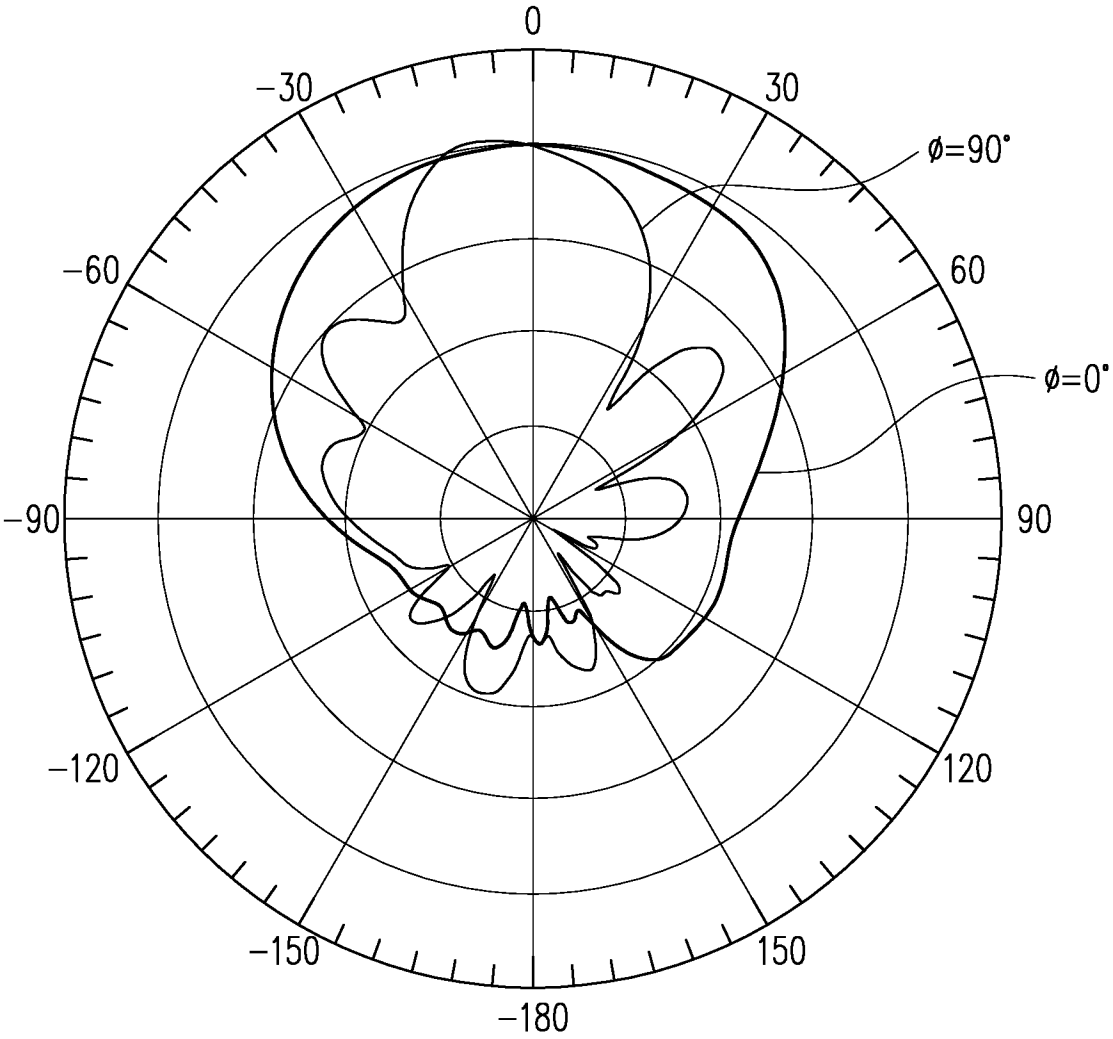
FIG. 3A to FIG. 3C are radiation pattern diagrams corresponding to an antenna structure in FIG. 2 at three frequency points of 77 GHz, 79 GHz, and 81 GHz.
Figure 3B:
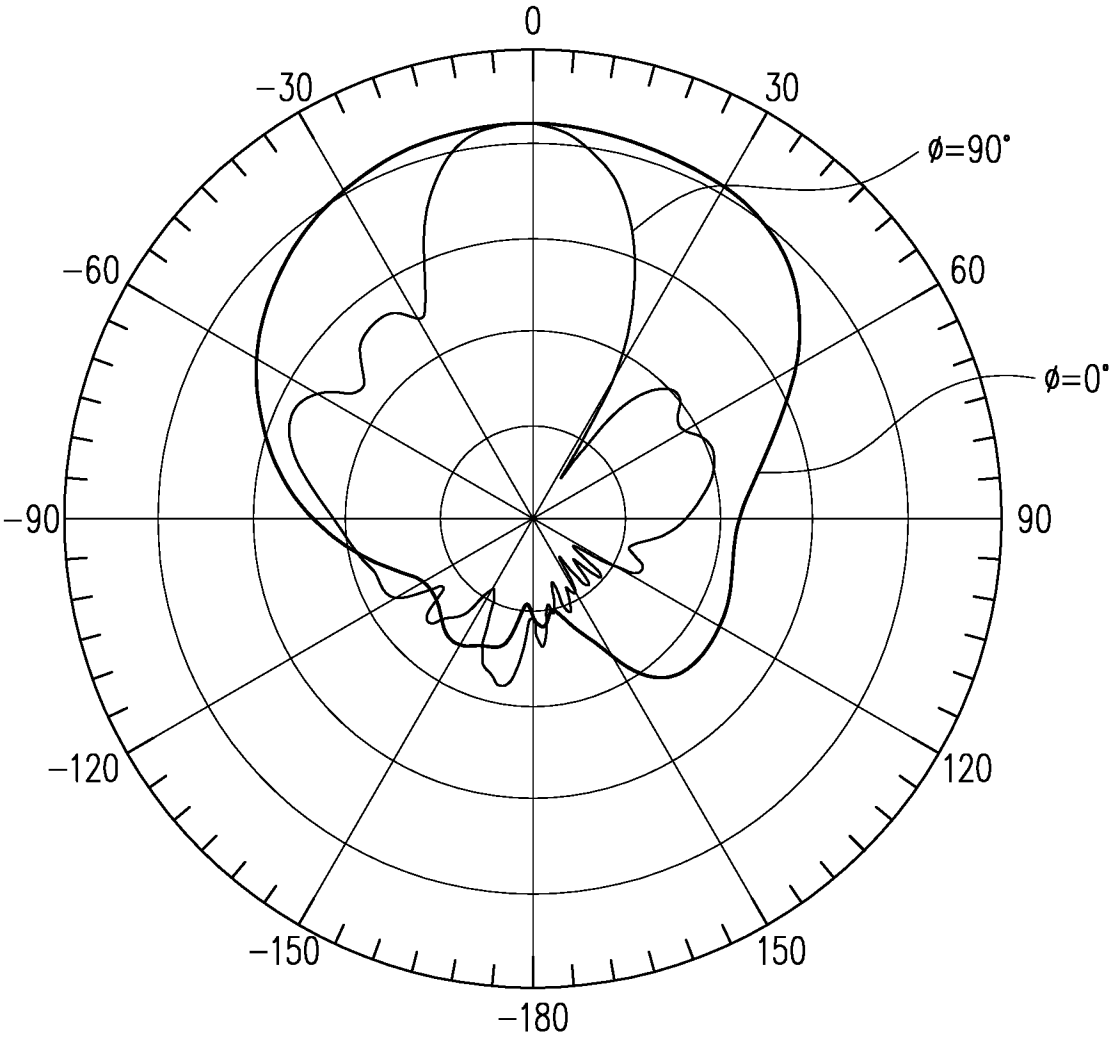
Figure 3C:
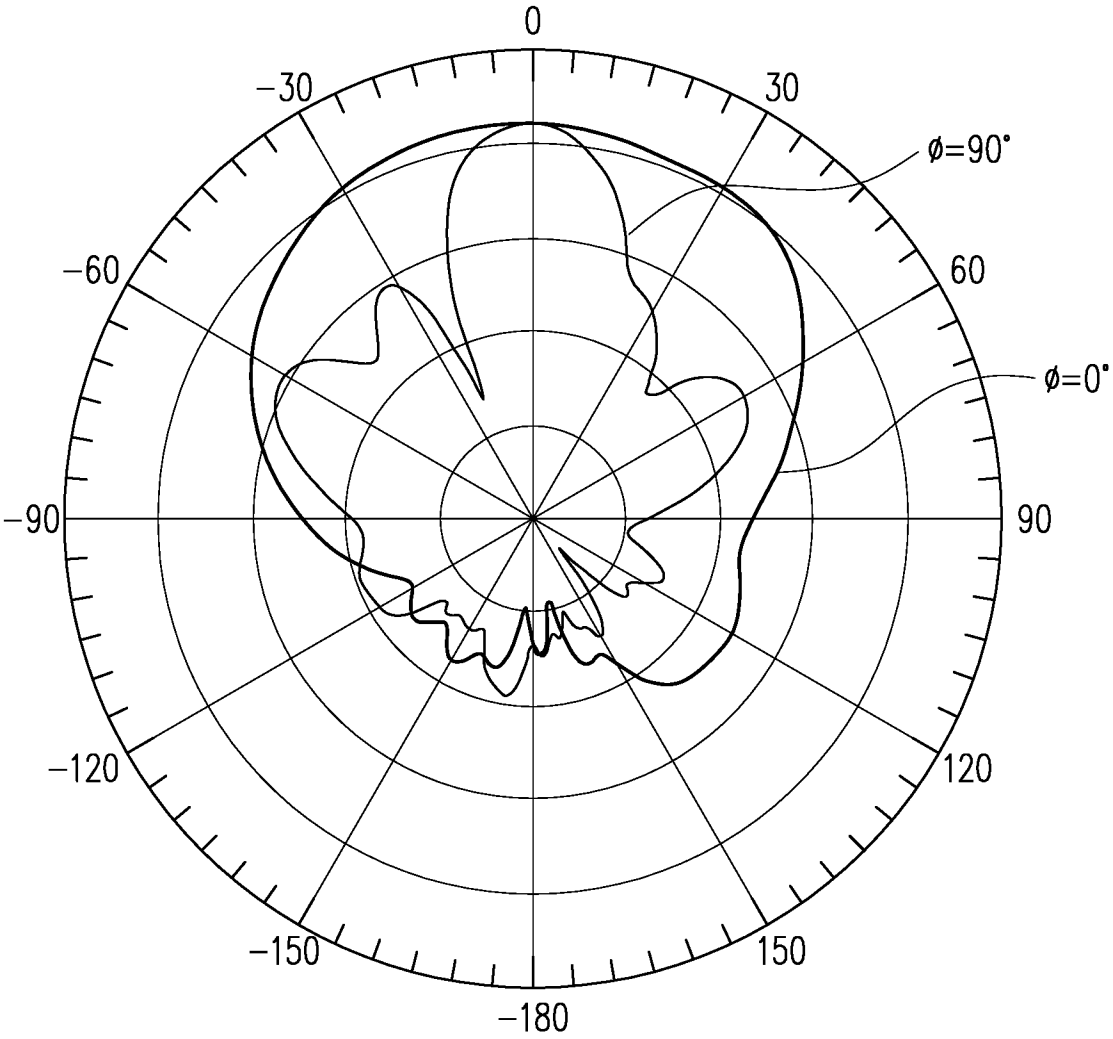

FIG. 3A to FIG. 3C are radiation pattern diagrams corresponding to an antenna structure in FIG. 2 at different frequency points of 77 GHz, 79 GHz, and 81 GHz. Referring to FIG. 3A to FIG. 3C, in this embodiment, maximum values of the antenna structure 10*a* in FIG. 2 in a field pattern in which $\psi$ is 0° and in a field pattern in which $\psi$ is 90° are both at a position of zero degrees on a Z axis, so that a mainlobe is more likely to aim at the zero degrees on the Z axis. In such a design, a sidelobe is about 10 dB lower than the mainlobe, so that a characteristic of the sidelobe is suppressed. Therefore, performance is good.

Figure 4:
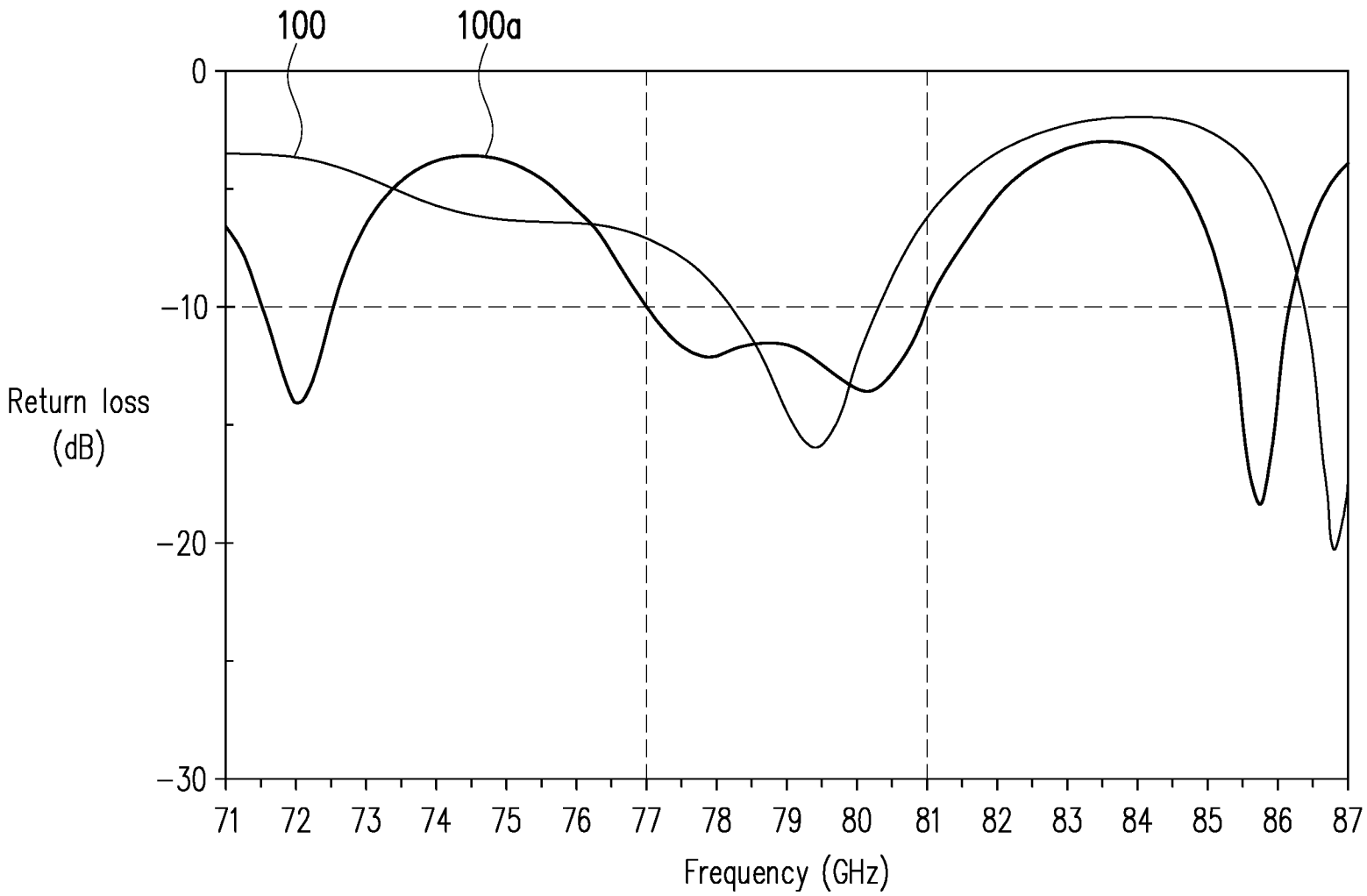
FIG. 4 is a diagram of frequency-return loss relationships of an antenna structure in FIG. 1A and an antenna structure in FIG. 2.

FIG. 4 is a diagram of frequency-return loss relationships of an antenna structure in FIG. 1A and an antenna structure in FIG. 2. Referring to FIG. 4, the antenna structure 10 in FIG. 1A and the antenna structure 10*a* in FIG. 2 both have a resonance frequency band at 77 GHz to 79 GHz, and a return loss at the frequency band from 77 GHz to 81 GHz can be less than −10 dB. Therefore, performance is good. The antenna structure 10*a* in FIG. 2 has two valleys in the resonance frequency band at 77 GHz to 79 GHz, and a junction of the two valleys is 79 GHz. A current return loss can be increased to 11.6 dB, and the bandwidth can be synchronously increased to 5.06%.

Figure 5:
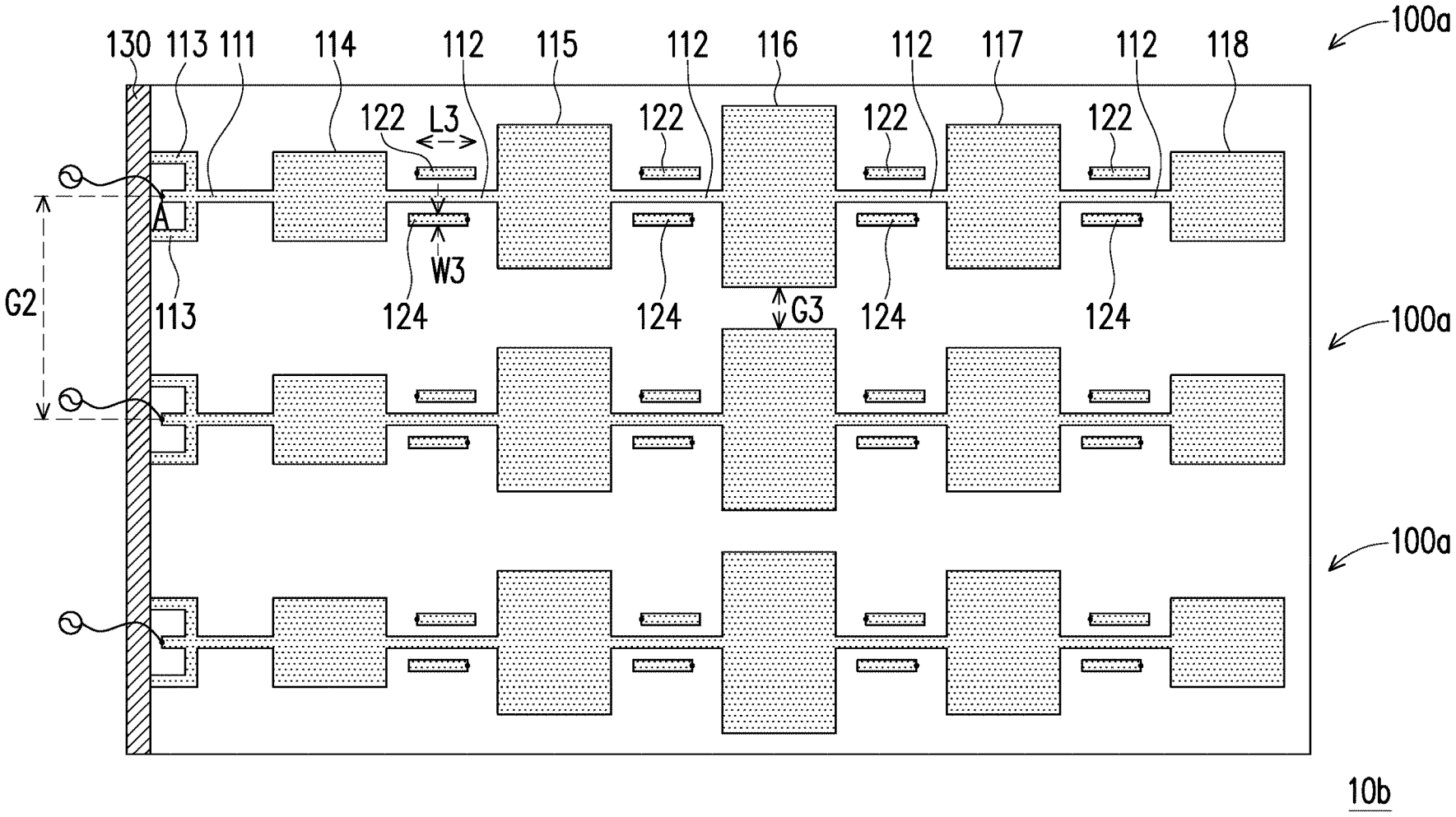
FIG. 5 is a schematic diagram of an antenna structure according to another embodiment of the present disclosure.

FIG. 5 is a schematic diagram of an antenna structure according to another embodiment of the present disclosure. In particular, a multi-antenna arrangement structure is shown. Referring to FIG. 5, in this embodiment, an antenna structure 10*b* includes a plurality of series-fed antennas 100*a* disposed beside the ground plane 130 side by side. The series-fed antenna 100*a* is the series-fed antenna 100*a* in FIG. 2 as an example. The series-fed antenna 100*a* has four second patches 115, 116, 117, and 118. However, in other embodiments, a number of the second patches of the series-fed antenna 100*a* is not limited thereto. In addition, in this embodiment, for example, there are three series-fed antennas 100*a*, but a number of the series-fed antennas 100*a* is not limited thereto.

As shown in FIG. 5, in this embodiment, a distance G2 between two feeding points of two adjacent ones of the series-fed antennas 100*a* is between 1.7 millimeters and 2.1 millimeters, for example, 1.9 millimeters. In addition, a minimum distance G3 between two adjacent ones of the series-fed antennas 100*a* is between 0.29 millimeters and 0.37 millimeters, for example, 0.33 millimeters. In this embodiment, when the series-fed antennas 100*a* are disposed at a transmitter end or a receiver end, the minimum distance G3 in the range can meet all antenna characteristics of each of the series-fed antennas 100*a*.

Figure 6:
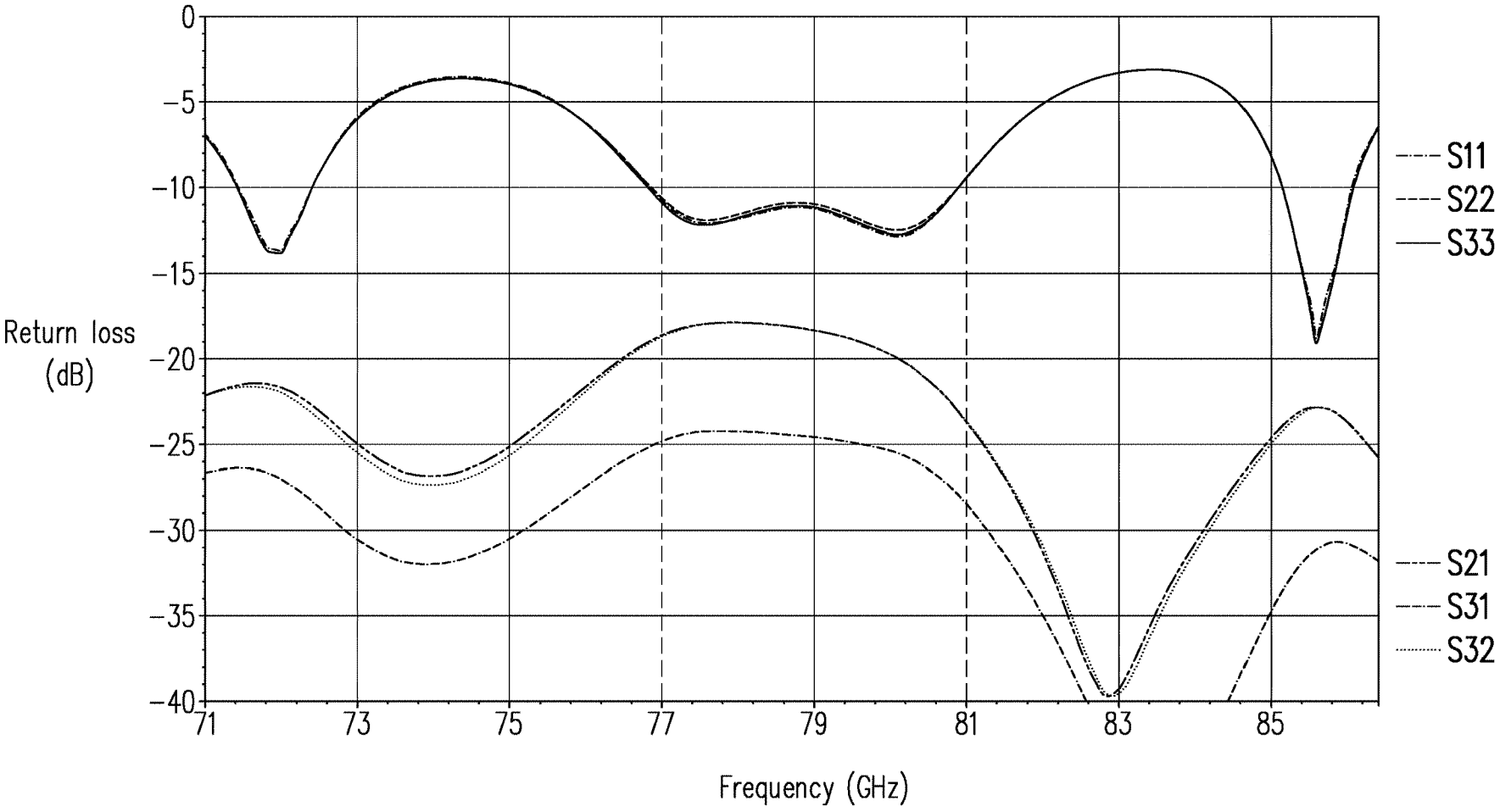
FIG. 6 is a diagram of a frequency-return loss relationship of an antenna structure in FIG. 5.

FIG. 6 is a diagram of a frequency-return loss relationship of an antenna structure in FIG. 5. Referring to FIG. 6, in this embodiment, if an uppermost series-fed antenna 100*a* in FIG. 5 is used as a first series-fed antenna 100*a*, a central series-fed antenna 100*a* is used as a second series-fed antenna 100*a*, and a lowermost series-fed antenna 100*a* is used as a third series-fed antenna 100*a*, it may be learned from FIG. 6 that return losses S11, S22, and S33 of the three series-fed antennas 100*a* at the frequency band from 77 GHz to 81 GHz are all less than −10 dB. Therefore, performance is good. In addition, isolations S21, S32, and S31 between two adjacent series-fed antennas 100*a* can be below −17.9 dB, and therefore the isolation is good.

In summary, in an embodiment of the present disclosure, in the antenna structure, the two first grounding traces are symmetrically disposed on the two opposite sides of the first microstrip line and extend to the ground plane, and the two second grounding traces are symmetrically disposed on two opposite sides of the second microstrip line and grounded in different directions respectively. After test, through the above design, a range of a frequency band coupled out by the antenna structure and an impedance bandwidth can be increased, so that the antenna structure has a good antenna characteristic.

Although the present disclosure is described with reference to the above embodiments, the embodiments are not intended to limit the present disclosure. A person of ordinary skill in the art may make variations and modifications without departing from the spirit and scope of the present disclosure. Therefore, the protection scope of the present disclosure should be subject to the appended claims.

What is claimed is:

1. An antenna structure, comprising:

a ground plane; and at least one series-fed antenna comprising:

a first patch;

a plurality of second patches, wherein the first patch is arranged between the ground plane and the second patches, and the first patch and the second patches are arranged along a straight line;

a first microstrip line extending from the first patch in a direction away from the second patches and having a first end and a second end opposite to each other, wherein the first end is a feeding point, and the second end is connected to the first patch;

a first grounding structure group comprising two first grounding traces, wherein the two first grounding traces extend symmetrically from opposite sides of the first microstrip line to the ground plane;

a plurality of second microstrip lines respectively connected between the first patch and the second patch adjacent to the first patch and connected between the second patches; and a plurality of second grounding structure groups respectively disposed on both sides of the second microstrip lines and coupled to the ground plane.

2. The antenna structure according to claim 1, wherein each of the second grounding structure groups comprises two second grounding traces symmetrically disposed on the both sides of the corresponding second microstrip line, each of the second grounding traces comprises a first end and a second end, and in each of the second grounding structure groups, the first end and the second end of one of the second grounding traces respectively correspond to the second end and the first end of another of the second grounding traces, and the two first ends are coupled to the ground plane.

3. The antenna structure according to claim 1, wherein in each of the series-fed antennas, an area of the first patch and areas of the second patches increase and then decrease along a direction in which the straight line extends.

4. The antenna structure according to claim 1, wherein in each of the series-fed antennas, there are two second patches, and there are two second microstrip lines, an area of the first patch is the same as an area of the second patch far away from the first patch and less than an area of the second patch adjacent to the first patch.

5. The antenna structure according to claim 1, wherein in each of the series-fed antennas, there are four second patches, and there are four second microstrip lines, an area of the first patch is the same as an area of the second patch farthest away from the first patch and is a half of an area of the second patch at a central position.

6. The antenna structure according to claim 1, wherein each of the first grounding traces comprises a first segment and a second segment connected in a bent manner, the first segment extends vertically from the first microstrip line, and the second segment is parallel to the first microstrip line and is connected to the ground plane.

7. The antenna structure according to claim 1, wherein the antenna structure is adapted to couple out a frequency band, in each of the series-fed antennas, a length of each of the first grounding traces is between 0.22 times and 0.28 times a wavelength of the frequency band.

8. The antenna structure according to claim 1, wherein the antenna structure is adapted to couple out a frequency band, in each of the series-fed antennas, a length of the first microstrip line is 0.39 times to 0.42 times a wavelength of the frequency band.

9. The antenna structure according to claim 1, wherein the antenna structure is adapted to couple out a frequency band, in each of the series-fed antennas, a length of each of the second microstrip lines is 0.39 times to 0.42 times a wavelength of the frequency band.

10. The antenna structure according to claim 1, wherein the antenna structure is adapted to couple out a frequency band, in each of the series-fed antennas, each of the second grounding structure groups comprising two second grounding traces, a length of each of the second grounding traces is 0.2 times to 0.3 times a wavelength of the frequency band.

11. The antenna structure according to claim 1, wherein the at least one series-fed antenna comprises a plurality of series-fed antennas disposed beside the ground plane side by side, a minimum distance between adjacent ones of the series-fed antennas is between 0.29 millimeters and 0.37 millimeters, and a distance between two feeding points of two adjacent ones of the series-fed antennas is between 1.7 millimeters and 2.1 millimeters.

* * * * *